US005306184A

United States Patent [19]

Nakayama

[11] Patent Number: 5,306,184

[45] Date of Patent: Apr. 26, 1994

[54] OUTBOARD ENGINE EXHAUST SYSTEM

[75] Inventor: Manabu Nakayama, Hamamatsu-Shizuoka, Japan

[73] Assignee: Sanshin Kogyo Kabushiki Kaisha, Shizuoka, Japan

[21] Appl. No.: 917,236

[22] Filed: Jul. 23, 1992

[30] Foreign Application Priority Data

Jul. 24, 1991 [JP] Japan ..... 3-207436

[51] Int. Cl.[5] ..... B63H 21/00

[52] U.S. Cl. ..... 440/89; 181/235; 181/241

[58] Field of Search ..... 181/212, 219, 215–217, 181/235, 241, 247, 248; 440/88, 89; 248/580, 581, 634, 637, 638, 640

[56] References Cited

U.S. PATENT DOCUMENTS 3,045,423 7/1962 Hulsebus ..... 181/235
3,198,162 8/1965 Larsen ..... 440/89
3,431,882 3/1969 Irgens ..... 181/235
4,607,723 8/1986 Okazaki ..... 181/235
5,103,931 4/1992 Okazaki ..... 181/235

*Primary Examiner*—Robert J. Oberleitner
*Assistant Examiner*—Clifford T. Bartz
*Attorney, Agent, or Firm*—Bacon & Thomas

[57] ABSTRACT

A muffler for an exhaust system of an outboard engine is constructed in two parts, one being longer than the other with the longer portion being of standard length for various engine applications, while the shorter length muffler section is constructed to have variable lengths to accommodate various engine and propulsion unit applications. The lower muffler section is resiliently mounted to reduce transmittal of vibrations to the engine housing and associated structure. By constructing one of the muffler sections of a standard length for all engine applications, molding costs for various applications are reduced.

16 Claims, 2 Drawing Sheets

OUTBOARD ENGINE EXHAUST SYSTEM

BACKGROUND OF THE INVENTION

1. Field of the Invention

This invention concerns an exhaust system for outboard engines, in particular the structure of the muffler which comprises the exhaust system.

2. Background of Prior Art

Exhaust systems for outboard engines are typically constructed such that exhaust gases emitted from the engine are first expanded in an expansion chamber and then expelled to outside the engine. Normally, this expansion chamber is a long, narrow cylindrical muffler which is contained in an upper housing of the engine and associated propulsion system.

However, the upper housing of an outboard motor propulsion unit has a variable length depending upon the application for which the engine was designed, the type of engine and its specifications. This requires a variable length muffler for accommodating various types (i.e., lengths) of upper housings.

Mufflers for such engines, however, are normally formed by die casting or other metal casting methods, so separate molds are required to make mufflers of different lengths. Also, since mufflers are relatively long objects, these molds can be quite large. Thus, having to prepare large molds for each muffler having a different length in the prior art was a big factor in increased costs.

SUMMARY OF THE INVENTION

The first object of this invention, in consideration of the above problem, is to maintain costs at an absolute minimum when making mufflers of different lengths for outboard engine exhaust systems.

A second objective is to reduce the vibrations transmitted to the upper housing of the outboard engine propulsion unit from the muffler by providing an effective muffler support.

In order to obtain the above first objective, this invention provides an exhaust system for outboard engines where exhaust gas from the engine mounted on the upper housing is directed into an expansion chamber provided in the upper housing before being expelled outside the engine, and where the muffler comprising the above-described expansion chamber is characterized by being housed within the upper housing and being divided into two sections; a long section, which is common to various exhaust systems, and a short section which is used to adjust the overall length of each muffler to suit overall length requirements for various exhaust systems.

In order to achieve the second objective, the invention supports the long section of the muffler resiliently with respect to the upper housing of the engine.

By dividing the muffler into sections, and using the long section as a common part and adjusting the total length of the muffler by adjusting the length of the shorter section, the total length of the muffler can be adjusted by engine type, engine application and specifications. In other words, the mold used to make the long muffler section can be common to various applications, while the short section can be manufactured by changing the mold for that section only, thereby reducing the expense for molds.

Also, providing a resilient support for the long muffler section causes less transmittal of exhaust stream vibrations than providing a resilient support for the shorter section, because the longer section is subjected to stronger exhaust pulsations.

DETAILED DESCRIPTION OF THE PREFERRED EMBODIMENTS

Figure 1:
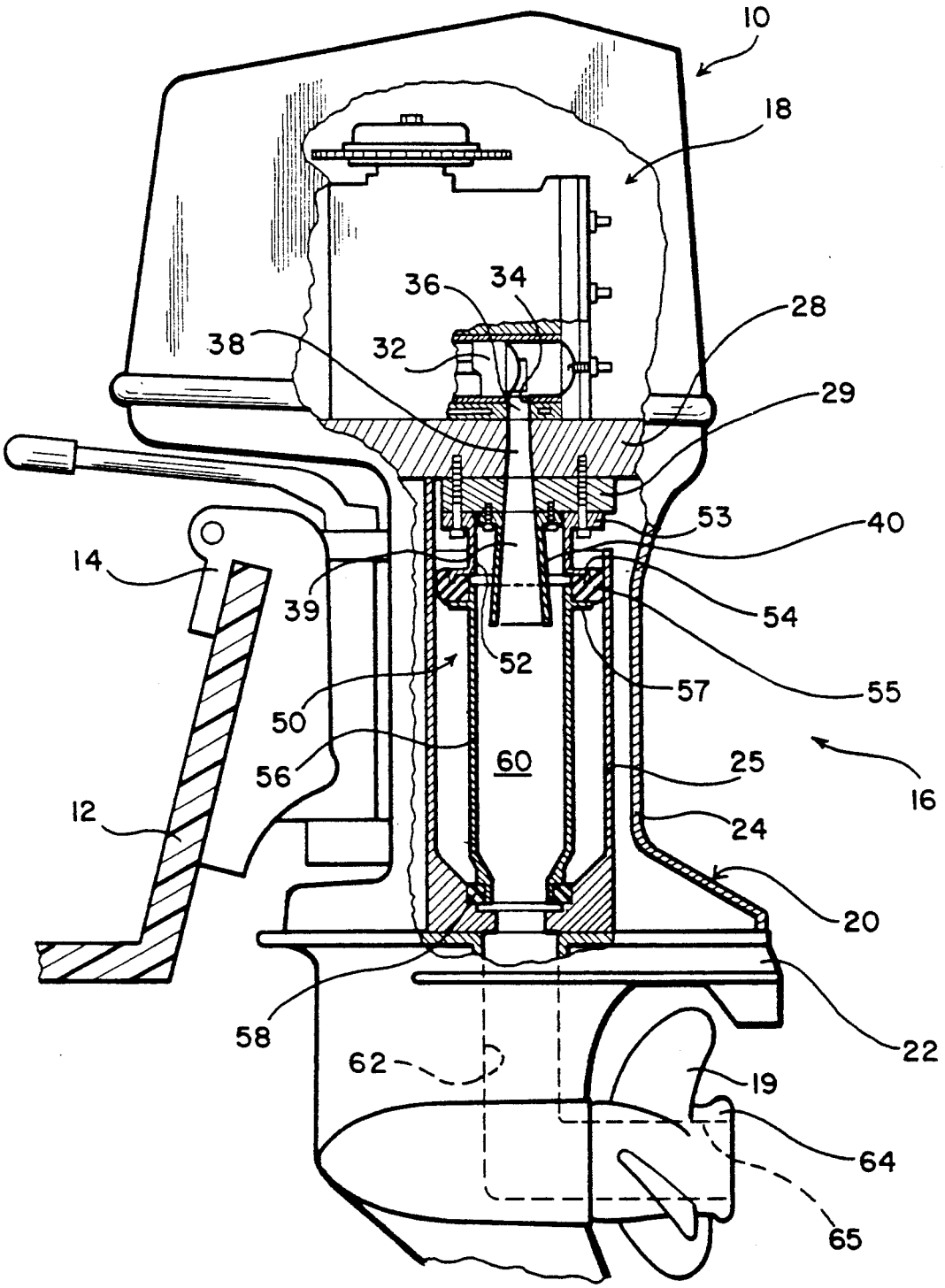
FIG. 1 shows a partial cross-sectional side view of an outboard engine and associated propulsion unit according to this invention.

As shown in FIG. 1, outboard engine 10 and its propulsion unit 16 are movably attached to the stern plate of the boat 12 by means of bracket 14. The propulsion unit 16 is mounted to the engine 18 via exhaust guide 28 at upper end of housing 20. This engine 18 is a water cooled engine that is cooled by taking in sea or other water. At the lower part of propulsion unit 16, a propeller 19 is provided which is rotated by a drive from engine 18.

The housing 20 comprises a top and bottom housing; that is, a lower casing or housing 22 and an upper casing or housing 24. The lower housing 22 is attached to the upper housing 24 by means of downward projecting bolts (not shown). The housings 22 and 24 are typically aluminum die castings.

An exhaust pipe 40 is bolted through an intermediate member 29 to the lower surface of exhaust guide 28. This exhaust pipe 40 diverges slightly along its length in the downward direction to form a diverging cylindrical passage. Inside upper housing 24, there is a cylindrical muffler support member or housing 25 which is metallurgically unitized (i.e., welded, etc.) with the upper housing 24 and which is spaced from the inner wall of upper housing 24. This cylindrical member 25 spaced from the wall of the housing 24 provides a double wall construction.

Inside the cylindrical member 25, there is a muffler 50 which has a similar cross sectional shape as the cylindrical member 25. This muffler 50 is divided into two sections, the shorter upper muffler section 52 and the longer bottom muffler section 56 in this embodiment. These muffler sections 52 and 56 have been separately die cast from aluminum. If desired, the shorter section could be at the bottom, and the muffler could be formed in more than two parts, provided that only one part will be variable in length.

Figure 2:
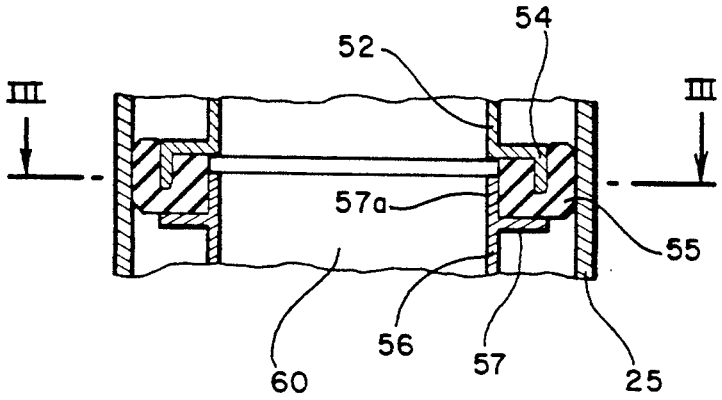
FIG. 2 is a cross-sectional enlarged view of one embodiment of a connection between muffler sections.
Figure 3:
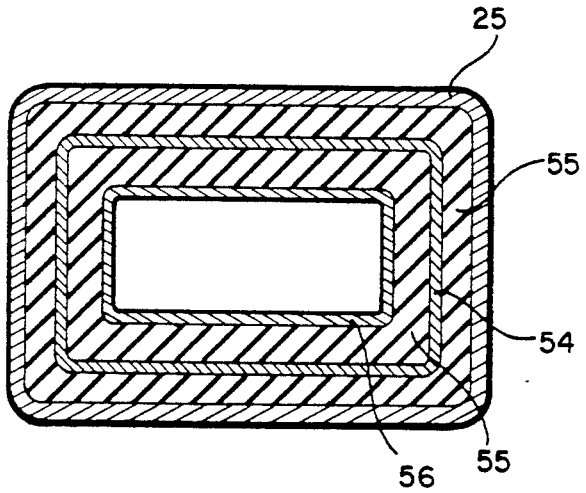
FIG. 3 is a cross-sectional view taken along line III—III of FIG. 2.

A flange 53 is provided at the top of the upper muffler section 52 and this flange 53 is bolted to the exhaust guide 28 via an intermediate member 29. The bottom edge of the upper muffler section has an enlarged diameter longitudinally extending skirt 54 (see FIG. 2) on which is mounted a rubber or elastomer mount 55. The lower muffler section 56 also has the rubber mount at its lower end which resiliently supports it at the bottom of the cylindrical member 25 of the upper housing 24. Also, just slightly below the top end of the lower muffler section 56 there is provided an integral flange 57 (see FIG. 2) with an enlarged diameter. This flange 58 engages rubber mount 55 as shown in FIG. 2.

In assembly, with the rubber mounts 55 and 58 in place, the upper muffler is affixed to the exhaust guide 28 and then, from the bottom, the lower muffler 56 is inserted so that flange 57 comes in contact with the rubber mount 55. As a result, the lower muffler 56 is sandwiched and elastically supported in fluid tight relationship between the upper and lower rubber mounts 55 and 58 between upper housing 24 and the exhaust guide 28. As seen in FIG. 2, the outside and inside of the rubber mount 55 are compressed between inner surface of cylindrical member 25 and the outer side of a portion 58*a* of the lower muffler 56, respectively. Flange 54 of upper section 52 also is disposed in the rubber mount 55 to prevent radial movement between the mount 55 and the upper section 52. This mounting system serves to inhibit vibrations in the radial direction at the junction of the upper and lower sections of muffler 50 and at the same time inhibits the transmittal of vibrations to the wall surfaces of cylindrical member 25.

An engine exhaust port 34 communicates with the cylinders of engine 18 and opens and closes through the reciprocal motion of piston 32 (i.e., for a two stroke engine). An exhaust passage 36 is formed inside engine 18 which connects to exhaust opening 34. There is also an exhaust passage 38 formed in the exhaust guide 28 and the intermediate member 29, as well as an exhaust passage 39 in the exhaust pipe 40. These exhaust passages 36, 38, 39 form a continuous passage from exhaust port 34. Inside muffler 50, there is a relatively large capacity expansion chamber 60 into which exhaust pipe 40 discharges. This expansion chamber 60 has sides formed by upper muffler section 52 and lower muffler section 56, a top bounded by the intermediate member 29 and a bottom bounded by the cylindrical member 25. Exhaust passage 62 has been formed in the lower casing 22 and this exhaust passage connects further with the exhaust passage 65 formed inside the boss or hub 64 of the propeller 62.

The exhaust gas which exits exhaust port 34 of the engine 18 passes through the exhaust passages 36, 38 and 39 to enter the expansion chamber 60, where it expands. After that, the exhaust passes through exhaust passages 62 and 65 before expelled into the water.

The lower muffler section 56 is a standard length apart, while the upper muffler section 52 has a length which is adjusted for the specific engine application, in other words according to engine and propulsion unit type, usage and specification. By joining the upper muffler section 52 with the standard part muffler section 56, it is possible to vary the overall length of muffler 50 to suit each application. Therefore, depending upon the engine and propulsion unit type, usage and specification, only the short muffler section must be made from a special mold; the long muffler section is a common part. This reduces the costs for making molds to the lowest possible level.

Since the expansion chamber 60 is in relatively close proximity to exhaust port 34, it receives high energy pulses from the exhaust entering the expansion chamber 60. Accordingly, muffler 50, which forms this expansion chamber experiences strong exhaust vibrations. Normally, these vibrations would be propagated to the upper housing 24, etc. which supports muffler 60, causing its outer wall to vibrate and produce noise. However, the rubber mounts 55 and 58 at the top and bottom of the longer lower muffler section 56 resiliently support and isolate the muffler and attenuate the propagation of these vibrations. Since the upper muffler section 52 is not resiliently supported by the exhaust guide 28, but is rather solidly supported, the vibrations of the upper muffler section 52 are propagated to the exhaust guide 28. However, since upper muffler section 52 is relatively short and the vibrations are relatively low in energy, the effective of these vibrations, even when propagated, is not too significant.

Figure 4:
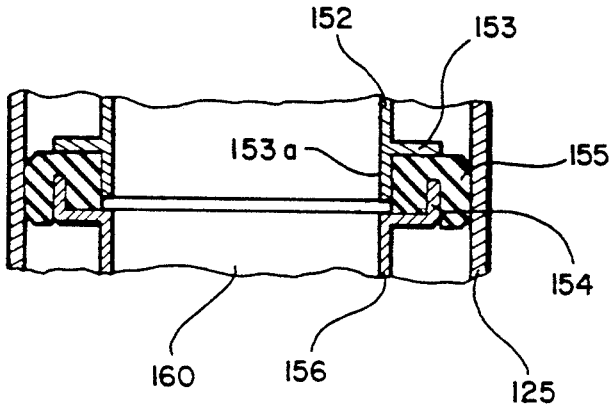
FIG. 4 shows another embodiment of a connection between muffler sections.

FIG. 4 shows details of a different connection between the upper and lower muffler sections, here designated as 152, 156. This embodiment is generally similar to the example in FIG. 2, but the difference is that flange 153 has been formed on the upper muffler section 152, while the broad diameter area 154 has been formed on lower section muffler 156. The rubber mount 155 is affixed to the enlarged diameter area 154 of the lower muffler 156. The assembly takes place with a rubber mount installed, with a lower muffler 156 being installed from below until the rubber mount 155 comes into contact with flange 153. Here, the rubber mount 155 is compressed between flange 153, and extension 153*a* of section 152, and cylindrical member 125, which prevents the juncture between muffler 152 and 156 from moving in the radial direction.

While preferred embodiments have been described, it is to be understood that various modifications can be made by a person skilled in the art without departing from the spirit and scope of the invention, which is intended to be defined solely by the appended claims.

I claim:

1. In an exhaust system for an outboard engine propulsion unit including an engine, a generally vertically extending muffler support member disposed below the engine, and a sound attenuation muffler mounted generally vertically in the muffler support member and arranged to receive engine exhaust gases from an exhaust passage that extends into the muffler, the improvement comprising:

said muffler including at least two sections longitudinally joined together with a single resilient joint connection therebetween such that one of said at least two sections extends the longitudinal length of the other of said at least two sections, and wherein a first of said sections is longer in length than a second of said sections and said single resilient joint connection further engages said muffler support member.

2. The improvement as claimed in claim 1, including resilient means for supporting said first section relative to said muffler support member.

3. The improvement as claimed in claim 1, wherein said second section is rigidly secured to said propulsion unit, and said first section extends from the bottom end area of the first section to the bottom area of the muffler support member, with the bottom end of said first section connected to the muffler support member bottom area, and a resilient, fluid tight connection for connecting the bottom end of the first section to the bottom area of the muffler support member.

4. The improvement as claimed in claim 1, wherein said muffler includes an external wall and said muffler support member includes an internal wall spaced from and enclosing said external wall, and wherein said resilient joint connection spans the space between the muffler external wall and the muffler support member inner wall to resiliently locate and support at least the first muffler section relative to the muffler support member inner wall.

5. The improvement as claimed in claim 2, wherein said resilient means for supporting said first section includes means for resiliently supporting the first section in longitudinal and transverse directions relative to the muffler support member.

6. The improvement as claimed in claim 5, wherein said resilient means for supporting said first section includes means for resiliently connecting the first section to the second section.

7. The improvement as claimed in claim 6, one of said first and second sections including an enlarged diameter longitudinally extending skirt, and wherein said resilient means for supporting said first said section relative to said muffler support member comprises an elastomer mount extending between and engaging both of said first section and said muffler support member, said skirt disposed within said elastomer mount.

8. The improvement as claimed in claim 1, wherein said exhaust passage opens into the first section of said muffler.

9. An exhaust system for an outboard engine propulsion unit having a particular muffler length specification, including a muffler comprising at least first and second longitudinally joined parts for conducting and acoustically silencing exhaust gases from an engine of the propulsion unit, and wherein at least the first part of said muffler is of constant length and the second part of the muffler has a length that is individually configured to accommodate the particular muffler length specification of the outboard propulsion unit, and a vibration isolator means for mounting the muffler relative to the propulsion unit including a resilient coupling extending between the first and second parts of said muffler and directly engaging the propulsion unit.

10. An exhaust system as claimed in claim 9, wherein said first part of said muffler is longer than the second part.

11. An exhaust system as claimed in claim 9, wherein said vibration isolation means includes means for supporting said second part against substantial radial or lateral movement relative to said first part.

12. An exhaust system as claimed in claim 9, wherein said propulsion unit includes an engine, a muffler support member extending generally vertically downwardly from the engine, and exhaust pipe for conducting engine exhaust gas to the upper area of the muffler support member, and wherein said muffler is disposed generally vertically in said muffler support member with the exhaust pipe in communication with the interior of the muffler, and said first and second muffler parts extend in axial alignment from the top area of the muffler support member to the bottom area of the muffler support member.

13. An exhaust system as claimed in claim 12, wherein said exhaust pipe opens into the first part of said muffler.

14. An exhaust system as claimed in claim 12, wherein said vibration isolator means includes means for supporting said first and second parts against substantial radial or lateral movement relative to said muffler support member.

15. An exhaust system as claimed in claim 12, wherein said first part of said muffler is disposed below the second part of said muffler, and said one end of said first part of said muffler is disposed at the bottom area of said muffler support member and said second part of said muffler is rigidly connected at its upper end to a respective propulsion unit.

16. An exhaust system as claimed in claim 12, wherein said muffler support member is cylindrical and encloses said muffler, said vibration isolation means includes means for supporting said second part against substantial radial or lateral movement relative to said muffler support member, said first part of said muffler is longer than the second part, said first part of said muffler including one end resiliently coupled to one end of the muffler support member and said second part of said muffler being rigidly connected to the propulsion unit.

* * * * *